US005352177A

United States Patent [19]

Walter

[11] Patent Number: 5,352,177

[45] Date of Patent: Oct. 4, 1994

[54] BUCKLE CHUTE FOLDER WITH ADJUSTABLE SPACING BETWEEN PLATES

[75] Inventor: Bernd H. Walter, Naples, Fla.

[73] Assignee: GBR Systems Corporation, Naples, Fla.

[21] Appl. No.: 958,807

[22] Filed: Oct. 9, 1992

[51] Int. Cl.[5] ..... B31B 3/00; B41L 43/06

[52] U.S. Cl. ..... 493/23; 493/420; 270/32

[58] Field of Search ..... 270/32, 45; 493/23, 493/25, 28, 420, 421; 267/155, 157

[56] References Cited

U.S. PATENT DOCUMENTS

| | | | |
|---|---|---|---|
| 1,285,705 | 11/1918 | Hitchcock | 493/420 |
| 1,606,459 | 11/1926 | Waterworth | 493/420 |
| 1,779,105 | 10/1930 | Price | 493/421 |
| 3,995,849 | 12/1976 | Kistner | 493/420 |
| 4,518,380 | 5/1985 | Shimizu et al. | 493/420 |
| 5,044,617 | 9/1991 | Roberts | 270/45 |
| 5,234,399 | 8/1993 | Boughton et al. | 493/421 X |

FOREIGN PATENT DOCUMENTS

| | | | |
|---|---|---|---|
| 2360658 | 6/1974 | Fed. Rep. of Germany | 493/421 |
| 447017 | 5/1936 | United Kingdom | 270/68 |
| 1094005 | 12/1967 | United Kingdom | 493/420 |

*Primary Examiner*—Edward K. Look
*Assistant Examiner*—John Ryznic
*Attorney, Agent, or Firm*—Stoll, Miskin, Previto & Hoffman

[57] ABSTRACT

A buckle folder having upper and lower plates. Each plate has a front and a rear end with the two plates connected to each other at their rear ends. The plates are movable relative to each other so that the space between the two plates may be adjusted to accommodate different thicknesses.

11 Claims, 1 Drawing Sheet

BUCKLE CHUTE FOLDER WITH ADJUSTABLE SPACING BETWEEN PLATES

BACKGROUND

The present invention relates to buckle folders for folding sheets of paper and more particularly to buckle folder plates.

Typical buckle folders are designed to accept single documents or sheets to be folded. Accordingly, the dimension of the paper gap between the buckle or fold plates is designed in relation to the anticipated general paper thickness.

Depending on the number of fold plates or buckle plates employed, the first fold plate usually has the smallest gap with subsequent fold plates progressively increasing the gap between the plates because of the increased paper thickness due to the progression of the folds.

In recent years, folders of the buckle plate design have been employed as part of automated mail processing systems wherein continuous forms or cutsheet documents are singulated, optically read for group or address association, accumulated by address definition and folded as a set. The term for this kind of folding is "nestfolding".

The nestfolded document package is then transferred to an inserting system for adding additional inserts and ultimate enveloping and franking, etc.

When processing individual documents, the paper thickness increases, depending upon the fold characteristic, is very predictable and can therefore be fixed for all fold plates employed within a particular system. However, when the number of documents to be sent to a folder vary between approximately 1 and 15 pages, for example, the space accommodation within the fold plates needs to account for this variance in thickness.

The basic design criteriae for buckle fold plates has the distance between the fold plates usually kept as small as convenient in order to permit the easy movement of the paper between these plates. However, at the same time the distance between the fold plates should be as tight as possible in order to prevent the paper from bowing out or crumpling when the leading edge of the paper reaches the buckle plate paper stop and the continuously running folder rollers are creating the buckle for the fold. The wider the gap within the foldplate, the less accurate is the fold performance.

Fixed gap buckle plates in buckle folders are fixed for a certain number of sheets. If it is desired to feed and fold one sheet and thereafter three sheets the buckle plates must be adjusted in order to accommodate the increased thickness. This requires shutting down the operation and adjusting the gap between the buckle plates. When a different thickness of sheets is to be folded, the gap between the buckle plates must again be adjusted. This results not only in time consuming operations but expensive interruptions in the flow of the sheets being folded.

OBJECTS

The present invention overcomes these difficulties and provides an improved buckle folder plate which permits more than a single sheet to be inserted between the buckle plates.

Another object of the present invention is the provision of an improved buckle plate folder in which the space in between the two plates may be adjusted.

Another object of the present invention is the provision of an improved buckle plate folder in which the gap between the two plates is automatically adjusted.

Another object of the present invention is the provision of an improved buckle plate folder in which the adjustment of the gap between the two plates may be limited.

Other and further objects of the invention will be obvious upon an understanding of the illustrative embodiment about to be described, or will be indicated in the appended claims and various advantages not referred to herein will occur to one skilled in the art upon employment of the invention in practice.

DRAWING

A preferred embodiment of the invention has been chosen for purposes of illustration and description and is shown in the accompanying drawings forming a part of the specification, wherein.

DESCRIPTION

Figure 1:
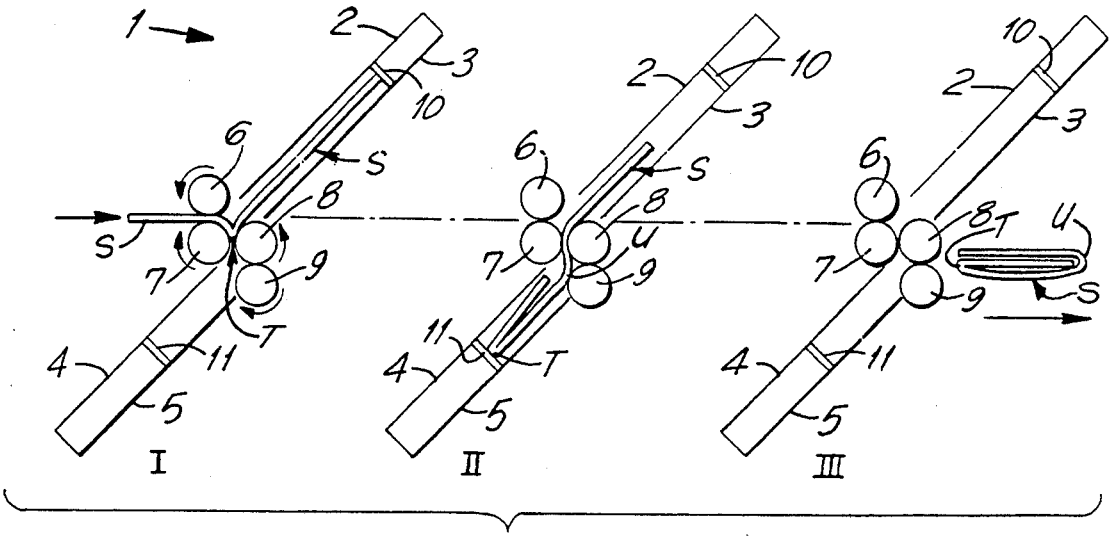
FIG. 1 is a diagrammatic showing of three steps I, II and III performed by a buckle folder when folding a sheet.

Referring to FIG. 1 which illustrates diagramatically the operation of a buckle folder, the buckle folder 1 comprises a first and second pair of spaced plates 2-3 and 4-5, respectively, and a plurality of rollers 6, 7, 8 and 9. The plates 2-3 and 4-5 each have a stop 10 and 11, respectively. A sheet S is fed by rollers 6-7 between the first pair of plates 2-3 until it strikes a stop 10 as shown in step I. With the continued movement of the rollers 6-7, the sheet S is grasped between rollers 7-8, is folded at T and moved backwardly by rollers 7-8 between the second pair of buckle plates 4-5 until it strikes the stop 11 as shown in Step II. With the further movement of the rollers 8-9, the sheet S is now folded again at U to form the finished product as shown in step III.

In order to accommodate the varying number of sheets of paper presented to the fold plates 2-3 and 4-5, the present invention comprises a buckle plate designed so that at least one plate of the buckle plate is adjustable to the paper thickness to be presented to the fold plate. The adjustability may be achieved through forced or weighted flexibility of a fold plate relative to the other and/or through a hinging of a fold plate relative to the other. Preferably the upper fold plate is adjustable relative to the lower fold plate 3.

Figure 2:
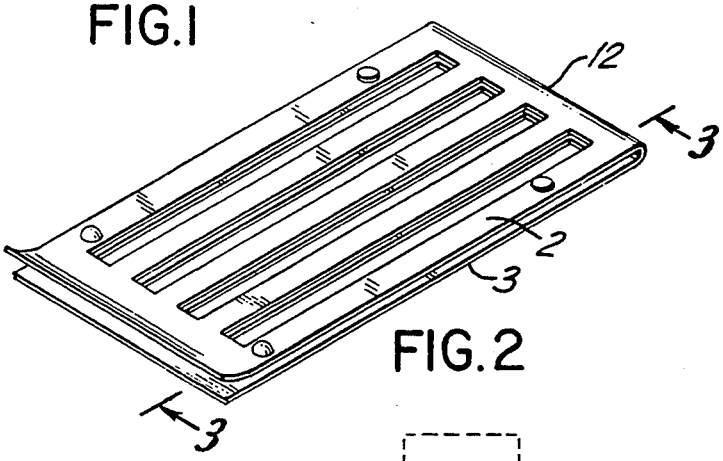
FIG. 2 is a perspective view of a buckle folder made in accordance with the present invention.
Figure 3:
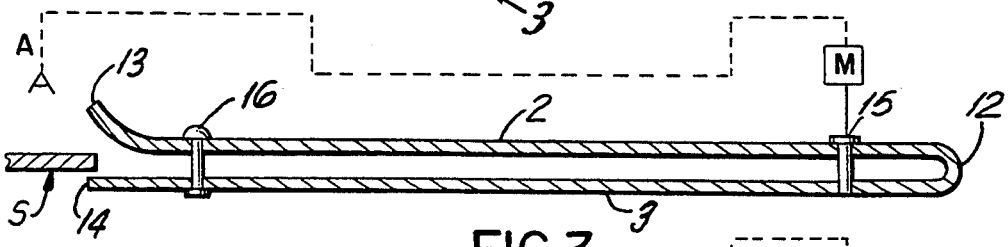
FIG. 3 is a sectional view taken along line 3—3 of FIG. 2.

As shown in FIGS. 2 and 3, the folder plates, e.g. 2-3, made in accordance with the present invention comprises a pair of fold plates 2-3 connected together at one end 12 by any well-known means, such as being integral with each other, spot welded together or held together by fasteners. The two plates 2-3 are spaced from each other in order to permit a sheet S to be inserted therebetween. The fold plate lips 13-14 are slightly spaced from each other in order to give adequate room for a sheet or sheets of paper S to be inserted therebetween. Preferably, as shown in the drawings, the lip 14 of the bottom plate 3 is substantially planar and the lip 13 of the top plate 2 is curved away from lip 14 of bottom plate 3.

It will be noted that being attached to each other at one end only, the two plates 2-3 are adjustable relative to each other so that the space between them may be adjusted. Any well-known adjusting means, such as a threaded adjusting screw 15, may be used in order to move the two plates 2-3 relative to each other to change the spacing between them.

If desired, a maximum expansion fastener 16 of any well known construction may be used in order to prevent the plates 2-3 from expanding beyond a certain predetermined point. This will avoid the top plate 2 from interfering with the folding operation.

Figure 4:
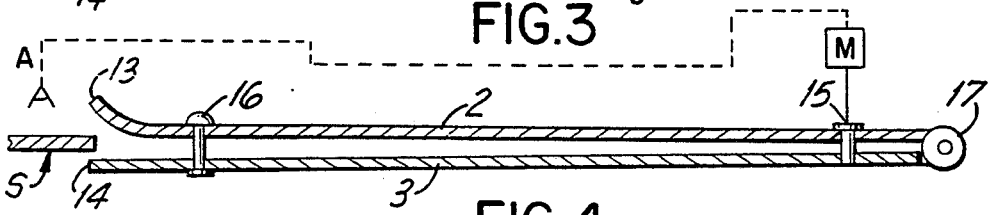
FIG. 4 is a sectional view similar to FIG. 3 showing another embodiment of the present invention.

In the embodiment shown in FIG. 4, the two plates 2-3 are held together at one end by a hinge 17, which may be a spring pressed hinge if desired. This permits the gap between the plates 2-3 to be easily adjusted to accommodate to variant thicknesses. In addition, with a spring-pressed hinge 17, the gap between the plates 2-3 may be automatically adjusted by the number of sheets S being fed between the plates 2-3. This same automatic adjustment may also be achieved by other means for holding plates 2-3 together, e.g., if the two plates 2-3 are one piece and resilient relative to each other.

Since the number of sheets (not shown) being processed is a known quantity before the sheets reach the folder 1, means may be provided for determining the number of sheets being processed and for sending this information to the folder 1 which will then automatically adjust the distance between the folder plates 2-3 in order to accommodate different quantities of sheets.

In other words, if one sheet is being processed, that information is sensed by any well-known sensing means and the information is sent to the folder mechanism 1 by any well-known transmitting means so that the distance between the plates 2-3 will be adjusted to accommodate one sheet. However, if immediately thereafter, a plurality of sheets is being processed, information is sensed and sent to the folding mechanism 1 so that the distance between the plates 2-3 will be increased to accommodate the ten sheets. In FIG. 4 the well-known sensing means and the well-known adjusting means are represented by boxes marked M and A respectively. Hence, the present invention provides means for automatically adjusting the distance between the plates 2-3 depending on the number of sheets that are being processed.

It will be seen that the present invention provides an improved buckle folder plate which permits more than a single sheet to be inserted between the buckle plates, in which the space in between the two plates may be adjusted, in which the gap between the two plates is automatically adjusted, and in which the adjustment of the gap between the two plates may be limited.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A buckle-chute folder for folding at least one sheet of paper comprising an upper and a lower plate facing each other, each plate having a front and a rear end, said plates being connected to each other at said rear end, said plates being movable toward and away from each other whereby the space between the two plates may be adjusted, means are provided to move the plates toward and away from each other to adjust the space between said two plates, and said hinge means are spring pressed hinge means.

2. A buckle-chute folder for folding at least one sheet of paper comprising an upper and a lower plate facing each other, each plate having a front and a rear end, said plates being pivotally connected to each other at said rear end, said plates being movable toward and away from each other around said pivotal connection whereby the space between the front ends of the two plates may be adjusted, and means are provided to adjust the space between said two plates.

3. A buckle folder as set forth in claim 2 wherein both of said plates have front edges and wherein the front edge of one of said plates is turned away from the front edge of the other plate.

4. A buckle folder as set forth in claim 3 wherein the front edge of the upper plate is curved away from the other plate.

5. A buckle folder as set forth in claim 2 wherein limiting means are provided in order to limit the movement of the plates relative to each other.

6. A buckle folder as set forth in claim 2 wherein the rear edges of said plates are connected together by connecting means.

7. A buckle folder as set forth in claim 6 wherein said plates are one piece and are resiliently movable relative to each other.

8. A buckle folder as set forth in claim 6 wherein said plates are connected by hinge means.

9. A buckle folder as set forth in claim 8 wherein said hinge means are spring pressed hinge means.

10. A buckle-chute folder as set forth in claim 2 wherein said folder is adapted to fold a number of sheets, sensing means are provided to determine the number of sheets to be folded, means are provided to transfer this information to the adjusting means to adjust the distance between the plates whereby the plates will accommodate the number of sheets which are to be folded.

11. A buckle-chute folder for folding a number of sheets of paper comprising an upper and a lower plate facing each other, each plate having a front and a rear end, said plates being connected to each other at said rear end, said plates being movable toward and away from each other whereby the space between the two plates may be adjusted, wherein means are provided to move the plates toward and away from each other to adjust the space between said two plates, sensing means are provided to determine the number of sheets to be folded and wherein means are provided to transfer this information to the adjusting means to adjust the distance between the plates whereby the plates will accommodate the number of sheets which are to be folded.

* * * * *